United States Patent [19]

Cobern et al.

[11] Patent Number: 4,761,889

[45] Date of Patent: Aug. 9, 1988

[54] METHOD FOR THE DETECTION AND CORRECTION OF MAGNETIC INTERFERENCE IN THE SURVEYING OF BOREHOLES

[75] Inventors: Martin E. Cobern, Cheshire; Frederick A. Stone, Durham; Edmund M. Hamlin, East Hampton, all of Conn.

[73] Assignee: Teleco Oilfield Services Inc., Meriden, Conn.

[21] Appl. No.: 905,979

[22] Filed: Sep. 10, 1986

Related U.S. Application Data

[63] Continuation of Ser. No. 608,365, May 9, 1984, abandoned.

[51] Int. Cl.[4] ..... E21B 47/022

[52] U.S. Cl. ..... 33/302; 33/312; 33/313

[58] Field of Search ..... 33/312, 300, 302, 304, 33/311, 312, 313, 303

[56] References Cited

U.S. PATENT DOCUMENTS 3,935,642 2/1976 Russell ..... 33/312 X
4,163,324 8/1979 Russell et al. ..... 33/313
4,357,660 11/1982 Hepp ..... 33/303

*Primary Examiner*—William D. Martin, Jr.
*Attorney, Agent, or Firm*—Fishman, Dionne & Cantor

[57] ABSTRACT

A method is presented, for use in borehole drilling, for correcting errors in azimuth determination resulting from variations in the earth's magnetic field to which a measuring instrument is exposed. The method distinguishes between variations in the earth's magnetic field caused by the drillstring and variation caused by external sources, and the method corrects only for errors caused by the drillstring. If the error is caused by the drillstring, an azimuth correction is made based on dip angle data, thereby reducing errors caused by scale factor variations since dip angle is a ratio quantity of magnetic field components.

18 Claims, 2 Drawing Sheets

METHOD FOR THE DETECTION AND CORRECTION OF MAGNETIC INTERFERENCE IN THE SURVEYING OF BOREHOLES

This application is a continuation of application Ser. No. 608,365, filed May 9, 1984, now abandoned.

BACKGROUND OF THE INVENTION

This invention relates to the field of borehole surveying or measurement. More particularly, this invention relates to a method for determining the directional parameter of borehole azimuth and correcting the azimuth for errors caused by perturbations in the earth's magnetic field.

The general class of such instruments used for borehole directional measurement use a three-axis magnetometer and a two-or three-axis accelerometer to determine the components of the earth's magnetic and gravitational fields in a coordinate system centered on the instrument. A straightforward geometric transformation is employed to determine the desired parameters defining the tool's orientation, namely the azimuth, inclination and tool face reference. For a prior art reference which describes this art and technique by means of a programmable Calculator, see "Hand-Held Calculator Assists in Directional Drilling Control", J. L. Marsh, Petroleum Engineer International, July & September 1982.

Azimuth is defined as the angle between magnetic north and the horizontal projection of the borehole axis. Measurement of the earth's magnetic field is commonly employed in determining azimuth. One common feature of any surveying device relying on the earth's magnetic field for the determination of azimuth is that a perturbation of the earth's magnetic field may result in an error in the measured azimuth. Such perturbation will hereinafter be referred to as magnetic interference. One source of magnetic interference may be within the drilling apparatus itself; i.e., it may arise from the presence of permeable, and possibly magnetized, materials in the drillstring. Another source of magnetic interference may be from an external source such as a ferrous ore body, or an adjacent well.

The existence of this source of error in azimuth measurement and the need to correct for the error has been recognized in the art, and attempts have been made to solve the problem. However, prior attempts to solve the problem have been deficient, and in some cases could actually result in greater errors in or greater unreliability of azimuth measurement; and the need for an accurate and reliable azimuth error correction system still exists.

The most relevant prior art known to the present inventors is disclosed in U.S. Pat. No. 4,163,324 to Russell et al (hereinafter the Russell et al patent). In the Russell et al patent, it is assumed that all interference is caused by magnetic material in the drillstring and is, therefore, axial (i.e., along the drillstring axis). No means are provided for verifying the validity of this assumption. If the assumption is wrong, then the correction made to azimuth measurement is also wrong; and this may actually lead to worsening of the results of the directional measurement system.

The system of the Russell et al patent also introduces another potential source of error in that it uses absolute values of the local magnetic field and absolute values of the earth's magnetic field in carrying out its azimuth correction procedure. The use of absolute values increases the sensitivity ot the method to scale factor errors, thus reducing or impairing the accuracy and reliability of the error correction.

SUMMARY OF THE INVENTION

The above discussed and other deficiencies of the prior art are overcome or alleviated by the system and method of the present invention.

The present invention provides a means for determining the presence of magnetic interference; and it also provides a means for distinguishing between internal interference (from the drilling itself) and external interference. In the case of internal interference, the value of the azimuth error introduced by this interference is determined and used to correct the measured azimuth. In the present invention the correction is based on dip angle quantities which are functions of ratios of measured or known values. The use of dip angle reduces the problem of errors in sensor scale factors. If the interference is from an external source, azimuth correction is not made. However, even if azimuth correction is not made, the system of the present invention is more reliable than the prior art because the driller knows (1) measurements are unreliable, (2) azimuth error correction cannot be made, and (3) there is an external source of magnetic interference. In this situation, alternative means, such as a gyroscopic survey may be employed for azimuth measurement.

As previously indicated, in the present invention no assumptions are made regarding the source or magnitude of the perturbing field. Measurements are made of three components of the ambient magnetic field and at least two components of the gravitational field in coordinate axes fixed relative to the tool. It is customary that these axes be the same for both sets of measurements, that they be orthogonal, and, furthermore, that one of these axes (generally designated as the z-axis) be along the tool axis and another (the y-axis) be in the direction of a reference or scribe line. Based on these readings, the three "drillers' angles", azimuth, inclination, and tool face reference may be determined, either at the surface or by a downhole microprocessor. In the presence of magnetic interference (and, in particular, the east-west component of such interference), the measured azimuth will be in error. In the present invention, at least two, and in the preferred embodiment, three, quantities are determined which are characteristic of the measured magnetic field of the tool. If three quantities are determined, one of these will be redundant (i.e., an algebraic combination of the others). When the determination is made downhole (e.g., in a measurement-while-drilling (MWD) system employing a downhole microprocessor), this redundancy allows a check of the data transmission and decoding by verifying the consistency of all of the results. The differences between the measured values of the earth's magnetic field and the nominal (i.e., charted) values for the particular region of the earth allow one to determine the magnitude of the interfering field along the tool axis. Rather than assume that this is the only interference, as is done in the prior art, the present invention tests the validity of this hypothesis by checking for self-consistency among all of the measurements. If the measured values are not consistent with the existence of purely axial interference, an estimate of the magnitude of the external interference is generated. If the test determines that only internal interference exists, a determination is then made of the azimuth error resulting from this interference. This error determination is based upon differences between measured and nominal dip angles, which angles are all derived from ratios of measurements, thereby reducing one source of potential error, i.e., a variation in scale factors in the downhole sensor.

BRIEF DESCRIPTION OF THE DRAWINGS

Referring to the drawings, wherein like elements are numbered alike in the several FIGURES.

DESCRIPTION OF THE PREFERRED EMBODIMENT

The present invention will be described with reference to and in the environment of a measurement-while-drilling (MWD) system. However, it will be understood that the invention is not limited to an MWD system; rather the invention may be employed in a wire line or other directional measurement system.

Figure 1:
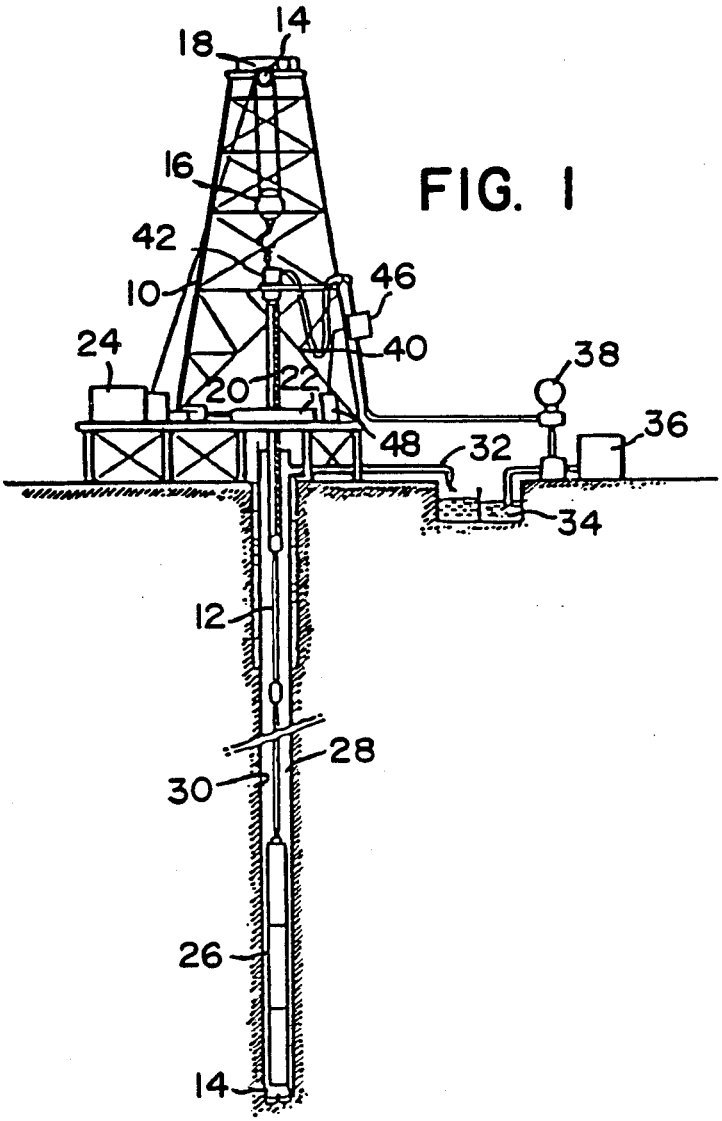
FIG. 1 is a generalized schematic view of a borehole and drilling derrick showing the environment of the present invention.
Figure 2:
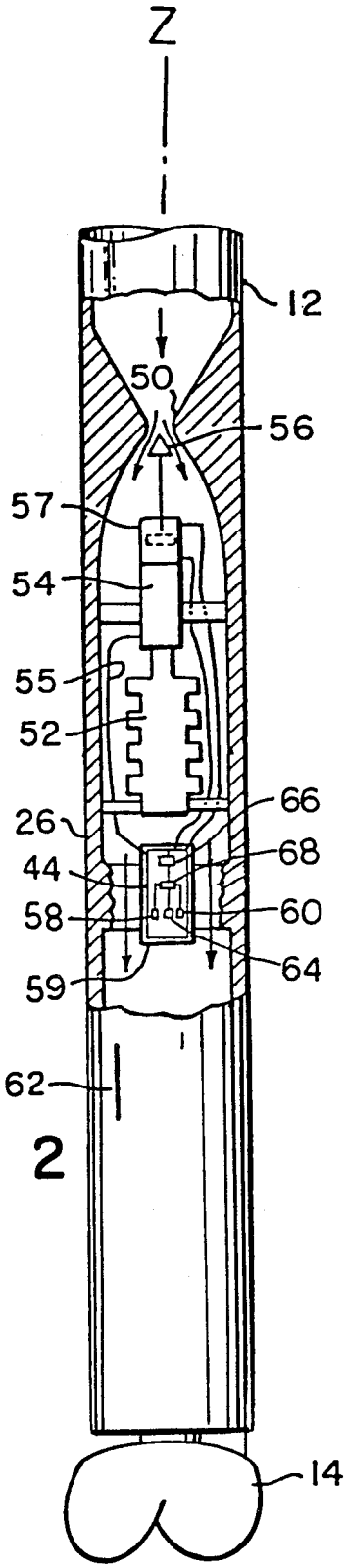
FIG. 2 is a view of a section of a drillstring of FIG. 1 showing, in schematic form, the drillstring environment of the present invention.

Referring first to FIGS. 1 and 2, the general environment of the present invention is shown. It will, however, be understood that these generalized showings are only for purposes of showing a representative environment in which the present invention may be used, and there is no intention to limit applicability of the present invention to the specific configuration of FIGS. 1 and 2.

The drilling apparatus shown in FIG. 1 has a derrick 10 which supports a drillstring or drill stem 12 which terminates in a drill bit 14. As is well known in the art, the entire drillstring may rotate, or the drillstring may be maintained stationary and only the drill bit rotated, either of which may be the environment of the present invention. The drillstring 12 is made up of a series of interconnected segments, with new segments being added as the depth of the well increases. The drillstring is suspended from a movable block 16 of a winch 18, and the entire drillstring may be driven in rotation by a square kelly 20 which slidably passes through but is rotatably driven by the rotary table 22 at the foot of the derrick. A motor assembly 24 is connected to both operate winch 18 and rotatably drive rotary table 22.

The lower part of the drillstring may contain one or more segments 26 of larger diameter and thicker walls than other segments of the drillstring (known as drill collars). As is well known in the art, these drill collars may contain sensors and electronic circuitry for sensors, and power sources, such as mud driven turbines which drive drill bits and/or generators and, to supply the electrical energy for the sensing elements.

Drill cuttings produced by the operation of drill bit 14 are carried away by a mud stream rising up through the free annular space 28 between the drillstring and the wall 30 of the well. That mud is delivered via a pipe 32 to a filtering and decanting system, schematically shown as tank 34. The filtered mud is then sucked by a pump 36, provided with a pulsation absorber 38, and is delivered via line 40 under pressure to a revolving injector head 42 and thence to the interior of drillstring 12 to be delivered to drill bit 14 and the mud turbine if a mud turbine is included in the system.

The mud column in drillstring 12 may also serve as the transmission medium for carrying signals of downhole parameters to the surface. This signal transmission is accomplished by the well known technique of mud pulse generation whereby pressure pulses are generated in the mud column in drillstring 12 representative of sensed parameters down the well. The drilling parameters are sensed in a sensor unit 44 (see FIG. 2) in a drill collar 26 near or adjacent to the drill bit. Pressure pulses are established in the mud stream within drillstring 12, and these pressure pulses are received by a pressure transducer 46 and then transmitted to a signal receiving unit 48 which may record, display and/or perform computations on the signals to provide information of various conditions down the well.

Referring briefly to FIG. 2, a schematic system is shown of a drillstring segment 26 in which the mud pulses are generated. The mud flows through a variable flow orifice 50 and is delivered to drive turbine 52. Turbine 52 powers a generator 54 which delivers electrical power to the sensors in sensor unit 44 (via electrical lines 55). The output from sensor unit 44, which may be in the form of electrical or hydraulic or similar signals, operates a plunger 56 which varies the size of variable orifice 50, plunger 56 having a valve driver 57 which may be hydraulically or electrically operated. Variations in the size of orifice 50 create pressure pulses in the mud stream which are transmitted to and sensed at the surface to provide indications of various conditions sensed by sensor unit 44. Mud flow is indicated by the arrows.

Since sensors in sensor unit 44 are magnetically sensitive, the particular drillstring segment 26 which houses the sensor elements must be a non-magnetic section of the drillstring, preferably of stainless steel or monel. Sensor unit 44 is further encased within a non-magnetic pressure vessel 59 to protect and isolate the sensor unit from the pressure in the well.

While sensor unit 44 may contain other sensors for directional or other measurement, it will include a triaxial magnetometer 58 (having 3 orthogonal "X", "Y" and "Z" windings), and a two (X, Y) or three (X, Y, Z) axis accelerometer 60. The sensitive axes of sensors 58 and 60 are aligned so that they coincide, with the Z axes being along or parallel to the Z axis of the drillstring and the Y axis perpendicular to the Z axis in the direction of a reference or scribe mark 62 on the drillstring. The X axes are orthogonal to Y and Z in a direction to make a right-handed coordinate system. Unit 44 contains a means of sensing rotation which may be a rotation sensor (as in U.S. Pat. No. 4,013,945 which is incorporated herein by reference) or a software means using a downhole processor; and directional measurements are taken only in the nonrotation state.

The sensor unit 44 also contains a temperature sensor 64 to provide temperature compensation for outputs of sensors 58 and 60, an analog to digital converter 68 (ADC) and a microprocessor 66 for analyzing the outputs from sensors 58 and 60 (as well as from other sensors). ADC 68 receives the signals from sensors 58 and 60 and delivers those signals in digital form to microprocessor 66 where the signals are also temperature compensated by the output from sensor 64. Microprocessor 66 then calculates various values, such as drillers' angles (azimuth, inclination, gravity tool face reference (GTF) or magnetic tool face reference (MTF)) (see FIG. 3) and the parameters that characterize the measured magnetic field. The outputs from microprocessor 66 are then delivered to valve driver 57 to operate valve 56 to create the mud pulse signals for eventual display and/or computation at unit 48.

In the following discussion, an explanation will be presented of the method of the present invention whereby (1) the nature of magnetic interference is determined and (2) azimuth error correction is effected if the interference is along the Z axis. To facilitate an understanding of that discussion, various terms will first be defined, sometimes with reference to FIG. 3. Notations used herein correspond to those of the articles by Marsh.

The term $\overline{H}$ means the magnetic field. Hx, Hy, Hz are components of $\overline{H}$ in the coordinate system of the tool and correspond to the three outputs of triaxial magnetometer 58. $\overline{G}$ refers to the force of qravity. Gx, Gy, Gz are components of $\overline{G}$ in the coordinate system of the tool and correspond to the three outputs of triaxial accelerometer 60. In all cases, the subscript "o" means an unperturbed, i.e., nominal value (such as from available charts). The absence of a subscript indicates a measured, value. A symbol with a bar (e.g., $\overline{H}$) refers to a vector; that symbol without the bar (e.g., H) refers to the magnitude of the vector.

Figure 3:
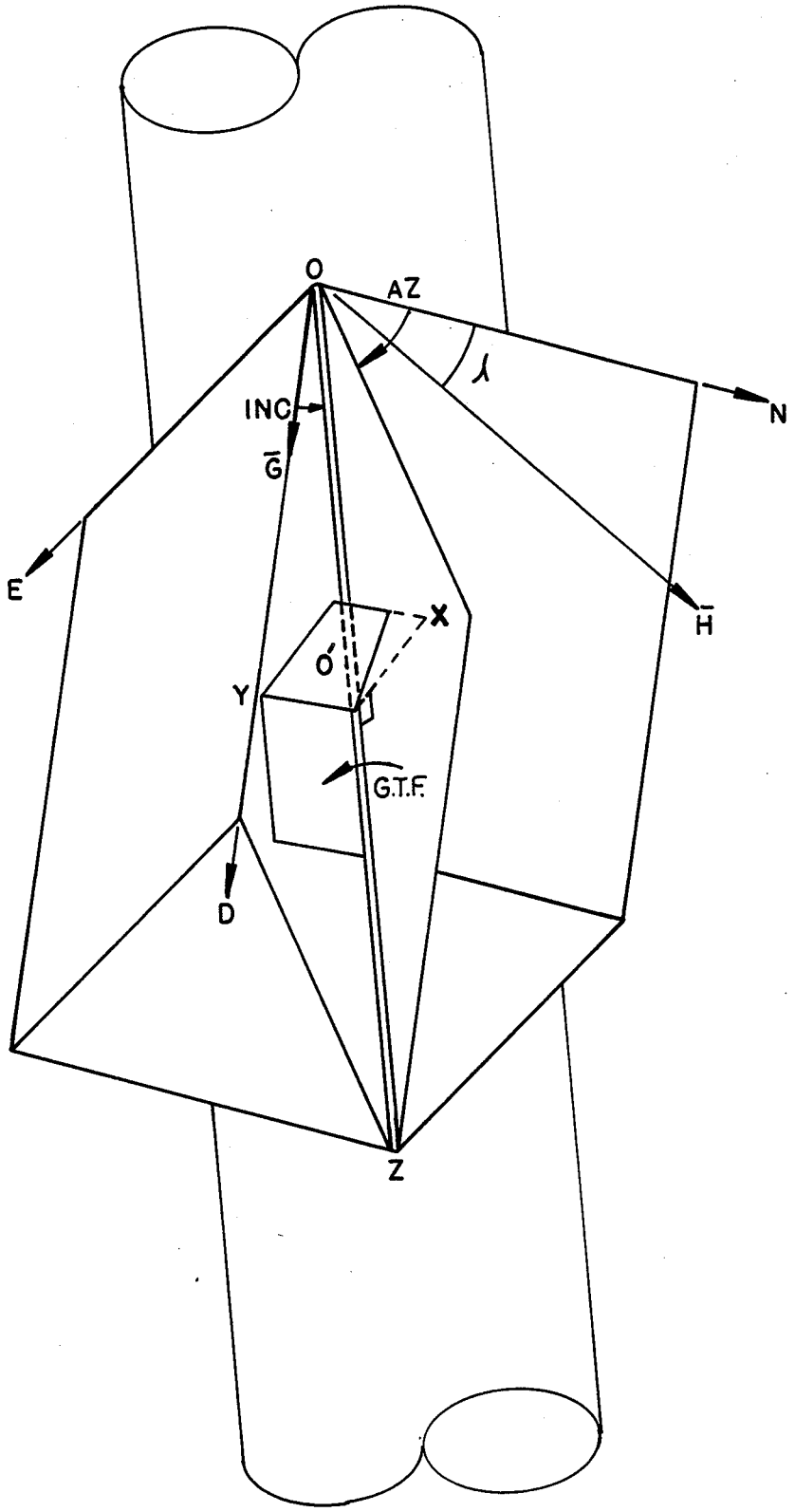
FIG. 3 is a perspective view of a drillstring segment showing the relationship of various axes, angles and vectors of interest in the present invention.

Referring to FIG. 3, one can see the relationship between the tool-related axes and those fixed to the earth. For clarity, the origin of the tool fixed axis has been displaced from O to O' and the Z (tool) axis is shown as a double line. The inclination angle INC is defined as the angle between the vertical line OD and the tool axis OZ. The gravity tool face reference angle GTF is defined as the angle between the vertical plane containing OD and OZ and the plane containing O'Z and O'Y. At low values of inclination, the magnetic tool face angle MTF (not shown) is employed, this being the angle between the vertical plane through OD and ON and the plane through O'Z and O'Y. The azimuth angle AZ is defined as the angle between the vertical plane through OD and ON and the vertical plane through OD and OZ . The relationships between the sensor readings and the angles INC, AZ and GTF (or MTF) are well known in the literature. The following relationships exist:

$$INC = \mathrm{TAN}^{-1}((Gx^2 + Gy^2)^{\frac{1}{2}}/Gz) \quad (1)$$

$$(0° \leqq INC \leqq 180°)$$

$$GTF = \mathrm{TAN}^{-1}(Gx/Gy) \quad (2)$$

$$(0° \leqq GTF < 360°)$$

$$MTF = \mathrm{TAN}^{-1}(Hx/Hy) \quad (3)$$

$$(0° \leqq MTF < 360°)$$

$$Az = \quad (4)$$

$$\mathrm{TAN}^{-1}\left(\frac{G^*(Hx\,Gy - Hy\,Gx)}{Hz^*(Gx^2 + Gy^2) + Gz^*(Hx\,Gx + Hy\,Gy)}\right)$$

$$(0° \leqq AZ < 360°)$$

Where:

$$G=(Gx^2+Gy^2+Gz^2)^{\frac{1}{2}}$$

In evaluating these equations, the value INC is taken between 0° and 180°, and the values of GTF, MTF and AZ lie between 0° and 360°.

It should be noted that, although the gravitational vector $\overline{G}$ lies along one of the earth-fixed coordinate axes OD, the magnetic field $\overline{H}$ will not, in general, coincide with the axis ON (i.e., the magnetic field will not be in the horizontal plane of ON, OE). The angle that the magnetic field makes with the horizontal plane containing ON and OE is the dip angle λ. This angle is positive in the northern hemisphere (i.e., the vertical component of $\overline{H}$ is downward) and negative in the southern hemisphere. In the preferred embodiment of this invention, three quantities which characterize the local magnetic field are determined by the downhole microprocessor 18. These are, the dip angle λ, the magnetic field vector magnitude H, and the axial field strength Hz. The equations for these quantities, in terms of the six sensor readings, are as follows:

$$\lambda = \mathrm{SIN}^{-1}\left(\frac{Gx\,Hx + Gy\,Hy + Gz\,Hz}{G\,H}\right) \quad (6)$$

$$(-90° \leqq \lambda \leqq 90°)$$

$$H = (Hx^2 + Hy^2 + Hz^2)^{\frac{1}{2}} \quad (7)$$

$$Hz = Hz \quad (8)$$

In the absence of magnetic interference, the first two of these quantities are independent of the orientation of the tool. Furthermore, equation (4) given above for azimuth angle is not dependent upon either the dip angle or total field strength. It only depends upon the assumption that the horizontal component of the earth's field points "North". The nominal values for the total field strength, dip angle and magnetic declination (i.e., the difference in heading between true geographic North and geomagnetic North) are tabulated for any latitude and longitude. In the following discussions, the term North will refer to the direction to the North geomagnetic pole; any correction for magnetic declination can be made after the fact.

In the presence of magnetic interference, any or all of the above magnetic quantities (e.g., (6)–(8)) may be affected. The only component of the interfering field which will influence the measured azimuth is that in the east-west direction, i.e., along the axis OE. The presence of such a component will violate the assumption that the local field points North. In the preferred embodiment, the current invention deals with such interference in the following steps, after determining the three quantities as above in the downhole microprocessor, and transmitting them to the surface.

(1) The expected value of the axial field Hzc is determined, based on the measured values of AZ, INC, H and λ from the following:

$$Hzc=H^*(\sin\lambda\cos INC+\cos\lambda\cos AZ\sin INC.) \quad (9)$$

This quantity should agree with the measured value of Hz, regardless of the nature and magnitude of the interference, since it represents only the geometric relationship among the various measurements and derived quantities. Since all of the quantities were determined downhole based upon the same set of sensor outputs, any difference between Hz and Hzc, beyond those introduced by the least count of the digitized signals, can be attributed to an error in signal coding, transmission or decoding. Thus, transmission of a redundant quantity, derivable from the other five parameters, permits a consistency check on the transmission process. It should be particularly noted that this consistency check is useful and can be performed independent of whether azimuth correction is desired or performed. If, in another embodiment, the output of the individual sensors are transmitted (by cable or MWD telemetry) such a check is not possible, since the sensor outputs are linearly independent.

(2) The expected value Hzo of the axial field is determined based upon the tabulated values of the total field and dip angle and the measured values of azimuth and inclination. The difference between this value Hzo and the measured value of Hz will give, to first order, the value of the axial component of the magnetic interference dHz. Thus:

$$Hzo = Ho^*(\sin \lambda o \cos INC + \cos \lambda o \cos AZ \sin INC) \quad (10)$$

$$dHz = Hz - Hzo \quad (11)$$

Some error will be introduced due to the fact that the measured, rather than the true (but unknown), azimuth is used in the calculation. In the case of purely internal interference, the calculation can be repeated after the first-order correction is applied to the azimuth reading, giving a better estimation of the azimuth error. For most levels of interference normally encountered, at most one such iteration will be necessary.

(3) If the interference is due solely to the magnetic material in the drillstring, and is therefore axial in nature, the component (Hp) of the earth's magnetic field perpendicular to the borehole axis will be unaffected by it. Such will not be the case if the interference is from an external source. The current invention determines the nature (i.e., internal or external) of the interference by comparing the magnitude of the measured perpendicular field to that expected from the nominal values of the geometric field. Any difference, beyond that attributable to the resolution of the sensors and the transmission system, is taken to be a result of external interference. Thus:

$$Hp = (Hx^2 + Hy^2)^{\frac{1}{2}} = (H^2 - Hz^2)^{178} \quad (12)$$

$$Hpo = (Ho^2 - Hzo^2)^{\frac{1}{2}} \quad (13)$$

$$dHp = Hp - Hpo \quad (14)$$

The value of Hp (Equation 12) is determined from measured values. The value of Hpo (Equation 13) is derived using the measured value of azimuth, and is therefore also only a first-order approximation. Also, equation 14 for dHp represents a lower limit on external interference, since the geomagnetic field and the external interference are vector quantities which can combine in different orientations. In certain cases, a finite external interference can combine with the geomagnetic field to give the measured value of Hp while still having a component perpendicular to the borehole. Thus, the actual perpendicular interference dHp must be equal to or greater than Hp−Hpo.

One way of avoiding such uncertainties is to compare the measured values of Hx and Hy individually to those predicted from the nominal geomagnetic field. In the embodiment which transmits the individual sensor outputs to the surface, the values of Hx and Hy are available directly. When the drillers' angles are transmitted, Hx and Hy are calculated as follows:

$$Hx = H^*(\cos \lambda(\cos AZ \cos INC \sin GTF + \sin AZ \cos GTF) - \sin \lambda \sin INC \sin GTF) \quad (15)$$

$$Hy = H^*(\cos \lambda(\cos AZ \cos INC \cos GTF - \sin AZ \sin GTF) - \sin \lambda \sin INC \cos GTF) \quad (6)$$

$$Hxo = Ho^*(\cos \lambda o(\cos AZ \cos INC \sin GTF + \sin AZ \cos GTF - \sin \lambda o \sin INC \sin GTF) \quad (17)$$

$$Hyo = Ho^*(\cos \lambda o(\cos AZ \cos INC \cos GTF - \sin AZ \sin GTF) - \sin \lambda o \sin INC \cos GTF) \quad (18)$$

$$dHx = Hx - Hxo \quad (19)$$

$$dHy = Hy - Hyo \quad (20)$$

$$dHp = (dHx^2 + dHy^2)^{\frac{1}{2}} \quad (21)$$

Equations 17 and 18 are predicted values based on tabulate fields and measured angles. While the method given above gives a determination, rather than just a lower limit, for the perpendicular (and therefore external) interference, the quantities calculated are all quite sensitive to errors in the values of azimuth and tool face reference. Therefore, for typical values of the external interference, the lower limit derived above may be more accurate than this calculation.

(4) If the above tests indicate that the difference in the perpendicular component of the interfering field is negligible, the effect of the axial interference upon the measured azimuth, i.e., the azimuth error dAZ is then determined.

To first order, the change in measured azimuth can be related to the difference d λ between the measured dip angle λ and the tabulated value λo.

$$dAZ = \frac{d\lambda \sin INC \sin AZ}{\cos \lambda o(\sin INC \cos AZ \sin \lambda o - \cos INC \cos \lambda o)} \quad (22)$$

Since, in equation 22, dAZ is taken to represent the difference between the measured azimuth AZ and the true azimuth AZo, the corrected azimuth AZ′ is given by:

$$AZ' = AZ - dAZ. \quad (23)$$

Since the measured azimuth appears in the equation for dAZ, this value will be slightly in error. This error can be reduced by replacing AZ in the equation by AZ′; the process can be repeated until a consistent value for dAZ is generated. In most cases, no iteration will be necessary, since the value of dAZ will be small.

(5) If the axial magnetic interference results from the remanent, rather than induced, magnetization of components in the drillstring, the magnitude of dHz may remain constant during drilling. This will be true if there are not any violent shocks to the drillstring, such as jarring or rotary drilling in hard rock. An examination of the equations reveals that, even for constant dHz, the measured values of H, Hz and λ will vary with azimuth and inclination. Where there is no apparent large discontinuity in dHz, the values for a bit run may be averaged to obtain a more accurate estimation of the interference.

Once such an estimation is made, it may be possible to refine the calculation of the azimuth error. The equation employed in the current invention to determine the azimuth error is strongly dependent upon the accuracy of the tabulated values for the geometric field. In particular, an error of a tenth of a degree in the nominal dip angle λo can result in an error of several tenths of a degree in the azimuth error (equation 22), at particular inclinations and azimuths. Using the average value of dHz for a given bit one can calculate the expected value of dλ:

$$d\lambda = \frac{dHz}{Ho}(\cos INC \cos \lambda o - \sin INC \cos AZ \sin \lambda o)\frac{180}{\pi} \quad (24)$$

By comparing the calculated value of d λ for each survey point with the measured value, one may find a small correction to λo which will give consistent values for the entire bit run.

Following the steps set forth above, the nature of the interference is determined (i.e., whether it is caused by the drillstring or by external sources). If the source is the drillstring, the azimuth error dAZ determined and the corrected azimuth AZ′ is established. No correction is made if the source of the interference is determined to be external.

The correction determination process of the present invention can be carried out manually or by computer.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. The method of determining a correction to be made to an azimuth measurement of an instrument in a borehole to compensate for magnetic interference, including the steps of:
   - determining the measured azimuth angle of the instrument;
   - determining the measured inclination angle of the instrument;
   - determining the measured dip angle;
   - ascertaining the true dip angle at the location of the borehole; and
   - calculating the error in azimuth measured caused by magnetic interference from the difference between said measured dip angle and said true dip angle and a factor determined from said measured azimuth angle, said measured inclination angle and said true dip angle.

2. The method of claim 1, further including:
   - determining the measured azimuth angle at the downhole location of the instrument and transmitting said azimuth angle measurement to the surface;
   - determining the measured dip angle at the downhole location of the instrument and transmitting said dip angle measurement to the surface;
   - determining the strength of the measured magnetic field and transmitting said magnetic field strength to the surface;
   - determining the strength of the measured component of the magnetic field along the axis of the instrument, and transmitting said measured component strength to the surface;
   - determining the inclination angle of the instrument at the downhole location of the instrument and transmitting said inclination measurement to the surface;
   - calculating the expected value of the component of the magnetic field along the axis of the instrument from the measured values of azimuth, inclination, magnetic field strength and dip angle; and
   - comparing said calculated and measured values of the component of the magnetic field along the axis of the instrument as a check on the consistency of transmission of data to the surface.

3. The method of claim 1, wherein said error, dAZ is determined by:

$$dAZ = \frac{(\lambda - \lambda o)(\sin INC \sin AZ)}{\cos \lambda o (\sin INC \cos AZ \sin \lambda o - \cos INC \cos \lambda o)}$$

where:
AZ=azimuth (measured)
dAZ=azimuth error
λ=dip angle (measured)
λo=dip angle (true)
INC=inclination 4. The method of determining a correction to be made to an azimuth measurement of an instrument in a drillstring in a borehole to compensate for magnetic interference, including the steps of:
   - determining the measured azimuth angle of the instrument,
   - determining the measured inclination angle of the instrument;
   - determining the measured dip angle;
   - ascertaining the true dip angle at the location of the borehole;
   - determining whether the source of magnetic interference is from the drillstring or from an external source; and
   - calculating the error in azimuth measurement caused by magnetic interference from the difference between said measured dip angle and said true dip angle and a factor determined from said measured azimuth angle said measured inclination angle and said true dip angle only in the case where the magnetic interference is determined to be from the drillstring.

5. The method of claim 4 wherein said step of determining the source of the magnetic interference includes:
   - determining the measured value of the component of the magnetic field perpendicular to the axis of the instrument;
   - determining the expected value of the component of the earth's magnetic field perpendicular to the axis of the instrument; and
   - determining the difference between said expected and measured values of the component of the earth's magnetic field perpendicular to the axis of the instrument to indicate the source of magnetic interference.

6. The method of claim 5 wherein:
   - the difference between said measured and expected values of the component of the earth's magnetic field perpendicular to the axis of the instrument is used as a measure of the magnitude of the magnetic interference arising from an external source.

7. The method of claim 4, further including:
   - determining the measured azimuth angle at the downhole location of the instrument and transmitting said azimuth angle measurement to the surface;
   - determining the measured dip angle at the downhole location of the instrument and transmitting said dip angle measurement to the surface;

determining the strength of the measured magnetic field and transmitting said magnetic field strength to the surface;

determining the strength of the measured component of the magnetic field along the axis of the instrument, and transmitting said measured component strength to the surface;

determining the inclination angle of the instrument at the downhole location of the instrument and transmitting said inclination measurement to the surface;

calculating the expected value of the component of the magnetic field along the axis of the instrument from the measured values of azimuth, inclination, magnetic field strength and dip angle; and comparing said calculated and measured values of the component of the magnetic field along the axis of the instrument as a check on the consistency of transmission of data to the surface.

8. The method of claim 4, wherein said error in azimuth measurement (dAZ) is:

$$dAZ = \frac{(\lambda - \lambda o)(\sin INC \sin AZ)}{\cos \lambda o (\sin INC \cos AZ \sin \lambda o - \cos INC \cos \lambda o)}$$

where:

AZ=azimuth (measured)

dAZ=azimuth error

λ=dip angle (measured)

λo=dip angle (true)

INC=inclination.

9. The method of checking the consistency of data transmission from an instrument in a downhole location is a borehole to the surface, inculding the steps of:

sensing a plurality of components of the earth's magnetic field at a downhole location in a borehole;

sensing a plurality of components of the earth's gravitational field at the downhole location in the borehole;

determining the measured azimuth angle at the downhole location of the instrument from a plurality of said sensed magnetic components and said sensed gravitational components and transmitting said azimuth angle measurement to the surface;

determing the measured dip angle at the downhole location of the instrument from a plurality of said sensed magnetic components and said sensed gravitational components and transmitting said dip angle measurement to the surface;

determining the strength of the measured magnetic field and transmitting said magnetic field strength to the surface;

determining the strength of the measured component of the magnetic field along the axis of the instrument, and transmitting said measured component strength to the surface;

determining the inclination angle of the instrument at the downhole location of the instrument from a plurality of said sensed gravitational components and transmitting said inclination measurement to the the surface;

calculating the expected value of the component of the magnetic field along the axis of the instrument from the measured values of azimuth, inclination, magnetic field strength and dip angle; and comparing said calculated and measured values of the component of the magnetic field along the axis of the instrument as a check on the consistency of transmission of data to the surface.

10. The method of determining a correction to be made to an azimuth measurement of an instrument in a borehole to compensate for magnetic interference, including the steps of:

sensing a plurality of components of the earth's magnetic field at a downhole location in a borehole;

sensing a plurality of components of the earth's gravitational field at the downhole location in the borehole;

determining the measured azimuth angle of the instrument from a plurality of said sensed magnetic components and said sensed gravitational components;

determining the measured inclination angle of the instrument from a plurality of said sensed gravitational components;

determining the measured dip angle from a plurality of said sensed magnetic components and said sensed gravitational components;

ascertaining the true dip angle at the location of the borehole; and calculating the error in azimuth measurement caused by magnetic interference from the difference between said measured dip angle and said true dip angle and a factor determined from said measured azimuth angle, said measured inclination and said true dip angle.

11. The method of claim 10, further including:

determining the measured azimuth angle at the downhole location of the instrument and transmitting said azimuth angle measurement to the surface;

determining the measured dip angle at the downhole location of the instrument and transmitting said dip angle measurement to the surface;

determining the strength of the measured magnetic field and transmitting said magnetic field strength to the surface;

determining the inclination angle of the instrument at the downhole location of the instrument and transmitting said inclination measurement to the surface;

calculating the expected value of the component of the magnetic field along the axis of the instrument from the measured values of azimuth, inclination, magnetic field strength and dip angle; and comparing said calculated and measured values of the component of the magnetic field along the axis of the instrument as a check on the consistency of transmission of data to the surface.

12. The method of claim 10, wherein said correction, dAZ is determined by:

$$dAZ = \frac{(\lambda - \lambda o)(\sin INC \sin AZ)}{\cos \lambda o (\sin INC \cos AZ \sin \lambda o - \cos INC \cos \lambda o)}$$

where:

AZ=azimuth (measured)

dAZ=azimuth error

λ=dip angle (measured)

λo=dip angle (true)

INC=inclination.

13. The method of claim 10, including the steps of:

determining whether the source of magnetic interference is from the drillstring or from an external source; and determining the error in azimuth measurement caused by magnetic interference as a function of the difference between said measured dip angle and said true dip angle only in the case where the magnetic interference is determined to be from the drillstring.

14. The method of determining a correction to be made to an azimuth measurement of an instrument in a drillstring in a borehole to compensate for magnetic interference, including the steps of:

sensing a plurality of components of the earth's magnetic field at a downhole location in a borehole;

sensing a plurality of components of the earth's gravitational field at the downhole location in the borehole;

determining the measured azimuth angle of the instrument from a plurality of said sensed magnetic components and said sensed gravitational components;

determining the measured inclination angle of the instrument from a plurality of said sensed magnetic components and said sensed gravitational components;

ascertaining the true dip angle at the location of the borehole;

determining whether the source of magnetic interference is from the drillstring or from an external source; and calculating the error in azimuth measurement caused by magnetic interference from the difference between said measured dip angle and said true dip angle and a factor determined from said measured azimuth angle, said measured angle inclination and said true dip angle only in the case where magnetic interference is determined to be from the drillstring.

15. The method of claim 14 wherein the step of determining the source of the magnetic interference includes:

determining the measured value of the component of the magnetic field perpendicular to the axis of the instrument;

determining the expected value of the component of the earth's magnetic field perpendicular to the axis of the instrument; and determining the difference between said expected and measured value of the component of the earth's magnetic field and perpendicular to the axis of the instrument to indicate the source of magnetic interference.

16. The method of claim 15 wherein:

the difference between said measured and expected values of the component of the earth's magnetic field perpendicular to the axis of the instrument is used as a measure of the magnitude of the magnetic interference arising from an external source.

17. The method of claim 14, further including:

determining the measured azimuth angle at the downhole location of the instrument and transmitting said azimuth angle measurement to the surface;

determining the measured dip angle at the downhole location of the instrument and transmitting said dip angle measurement to the surface;

determining the strength of the measured magnetic field and transmitting said magnetic field strength to the surface;

determining the strength of the measured component of the magnetic field along the axis of the instrument, and transmitting said measured component strength to the surface;

determining the inclination angle of the instrument at the downhole location of the instrument and transmitting said inclination measurement to the surface;

calculating the expected value of the component of the magnetic field along the axis of the instrument from the measured values of azimuth, inclination, magnetic field strength ad dip angle; and comparing said calculted and measured values of the component of the magnetic field along the axis of the instrument as a check on the consistency of transmission of data to the surface.

18. The method of claim 10, wherein said correction in azimuth measurement (dAZ) is:

$$dAZ = \frac{(\lambda - \lambda o)(\sin INC \sin AZ)}{\cos \lambda o (\sin INC \cos AZ \sin \lambda o - \cos INC \cos \lambda o)}$$

where:

AZ=azimuth (measured)

dAZ=azimuth error

λ=dip angle (measured)

λo=dip angle (true)

INC=inclination.

* * * * *